United States Patent [19]

Deutsch

[11] Patent Number: 4,532,848

[45] Date of Patent: Aug. 6, 1985

[54] GENERATION OF MUTATION PITCHES IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 569,134

[22] Filed: Jan. 9, 1984

[51] Int. Cl.[3] ..... G10H 5/07

[52] U.S. Cl. ..... 84/1.19; 84/1.23; 84/1.24

[58] Field of Search ..... 84/1.01, 1.19–1.24

[56] References Cited

U.S. PATENT DOCUMENTS 3,809,790 5/1974 Deutsch ..... 84/1.01
4,398,442 8/1983 Deutsch ..... 84/1.01 X
4,408,517 10/1983 Ellen ..... 84/1.19 X
4,446,769 5/1984 Deutsch ..... 84/1.01
4,450,746 5/1984 Deutsch ..... 84/1.24
4,489,637 12/1984 Deutsch ..... 84/1.22

*Primary Examiner*—Stanley J. Witkowski
*Attorney, Agent, or Firm*—Ralph Deutsch

[57] ABSTRACT

A musical waveshape generator is disclosed in which musical tones at mutation pitches corresponding to an actuated keyswitch are generated by selected attenuation of overtones of a square wave signal. A harmonic suppression means is described which is a combination of a low pass filter, a signal subtractor, and a rectangular waveshape generator whose state changes are controlled by a signal level comparator.

11 Claims, 4 Drawing Figures

GENERATION OF MUTATION PITCHES IN AN ELECTRONIC MUSICAL INSTRUMENT

BACKGROUND OF THE INVENTION

1. Field of the Invention

This invention relates to electronic music synthesis and in particular is concerned with the creation of musical tones that are harmonically related to the frequency of an actuated keyboard switch.

2. Description of the Prior Art

Electronic musical instruments such as organs, are distinguished from many other musical instruments in that a plurality of tone controls are implemented which produce musical tones at a variety of fundamental pitches. For historical reasons related to the design of wind blown organ pipes, the tone pitches are referred to as footages. The eight-foot pitch, or unison pitch, is one in which if the keyswitch corresponding to $A_4$ is actuated ("on" switch state) then the fundamental musical frequency is 440 Hertz. In addition to the unison pitch of 8-foot, there commonly are a set of octave pitches. For example, a four foot pitch will sound a tone having a fundamental frequency which is one musical octave higher than the actuated keyswitch. A two-foot pitch tone control will cause a tone to sound which has a fundamental frequency which is two musical octaves above the actuated keyswitch. A 16-foot pitch tone control will cause a tone to sound which has a fundamental frequency which is one musical octave below the actuated keyswitch.

Pipe organs, as well as many electronic keyboard musical instruments, traditionally contain fractional foot stops which are given the generic name of mutations. For example a $2\frac{2}{3}$-foot pitch stop will cause a tone to sound with a fundamental frequency which is equal to the third harmonic of the actuated keyswitch. A 1 3/5-foot pitch stop will cause a tone to sound with a fundamental frequency which is equal to the fifth harmonic of the actuated keyswitch. It is a relatively easy matter to build mutation tones for a pipe organ in which a separate rank (set) of pipes is associated with each of the stops, or tone controls. One simply tunes the pipes in the mutation rank to sound at the designated true harmonic of the actuated unison keyboard switch.

In most electronic keyboard musical instruments, an economical method of implementing mutation stops is to use a tone control system which has the generic name of unification. For example if a $2\frac{2}{3}$-foot tone control is actuated and the keyswitch corresponding to the musical note $C_4$ is actuated, then either by electrical or mechanical linkages, the keyswitch contacts corresponding to the musical note $E_6$ will be actuated. The linkage arrangement is such that $C_4$ will not sound and only the unified tone will sound. This system produces a tone whose fundamental is close, although not equal, to the true third harmonic frequency of the actuated keyboard switch. A similar linkage arrangement is used to obtain other mutation pitches such as the 1 3/5-foot pitch which produces an approximation to the true fifth harmonic of the tone corresponding to the actuated keyboard switch.

Accompanying the current trend to implement tone generators using large scale arrays of microelectronic elements has been the design trend to use a number of tone generators which is less than the number of keyswitches on an instrument's keyboard array of keyswitches. Unification methods to obtain mutation pitches can in, these systems, become a fairly costly option. In such system it is necessary to provide an additional separate and independent set of tone generators for each of the required mutation pitches.

In digital tone generators such as those described in U.S. Pat. No. 3,515,792 entitled "Digital Organ;" U.S. Pat. No. 3,809,789 entitled "Computer Organ;" and U.S. Pat. No. 4,085,644 entitled "Polyphonic Tone Synthesizer," higher than unison pitches are obtained by a scheme of harmonic suppression. Thus a 4-foot stop is obtained by using only the even numbered harmonics from the total set of possible harmonics and suppressing all the odd numbered harmonics. A $2\frac{2}{3}$-foot stop is obtained by using only the harmonic number sequence 3,6,9,12,15 . . . and suppressing all the other harmonics.

SUMMARY OF THE INVENTION

In a tone generator of the type in which all the musical frequencies are obtained from a top octave frequency synthesizer to provide an octave of square waves, mutation pitches are obtained by a process of signal phase cancellation. A threshold detector is implemented to provide phase cancellation information which is converted into a square wave at the mutation pitch. A $2\frac{2}{3}$-foot pitch is obtained from an input square wave by extracting the fundamental frequency of the square wave and determining six equal spaced threshold crossing points. These crossing points are used to create the mutation pitch square wave.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a musical tone generator in which a fractional pitch, or mutation pitch, is obtained by harmonic suppression of the harmonics in a square wave at the fundamental frequency. In particular it is directed toward tone generating systems of the generic type called "top-octave synthesizer" in which a multiplicity of square waveshapes are generated at octave related frequencies corresponding to a top-octave note which is assigned to a tone generator for an associated actuated instrument keyboard switch.

Figure 1:
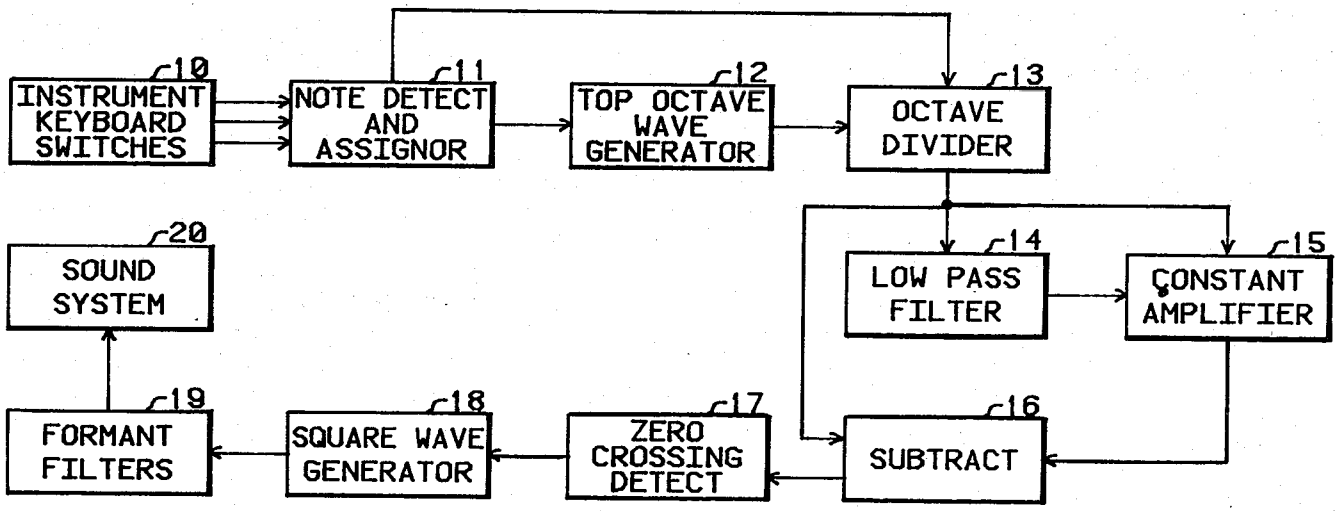
FIG. 1 is a schematic diagram of an embodiment of the invention.

FIG. 1 shows an embodiment of the present invention applied to a keyboard electronic musical instrument. An array of player actuable keyswitches are contained in the block labeled instrument keyswitches 10. If one or more of the keyboard switches has a switch status change and is actuated ("on" switch position), the note detect and assignor 14 encodes the detected keyboard switch having the status change to an actuated state and stores the corresponding note information for the actuated keyswitch. A top octave wave generator, contained in the system block labeled top octave wave generator 12, is assigned to each actuated keyswitch using the information generated by the note detect and assignor 11.

The note detect and assignor 11 generates and stores an assignment word corresponding to each actuated keyswitch. The assignment word is encoded to designate the octave number and musical note within the octave associated with the actuated keyswitch.

A suitable note detect and assignor subsystem is described in U.S. Pat. No. 4,022,098 which is hereby incorporated by reference.

The top octave wave generator assigned to an actuated keyswitch will generate a square wave at a musical frequency at the highest octave corresponding to the musical frequency of the actuated keyswitch. For example, if the highest octave for the instrument is the range of notes $C_7$ to $B_7$, then if the keyswitch for $A_4$ (corresponding to the frequency of 440 hz) is actuated, the top octave wave generator will generate a square wave at the musical frequency of $A_7$ (corresponding to a frequency of 3520 hz).

The octave divider 13 divides the top octave square wave to a square wave for the musical octave corresponding to the actuated keyswitch using the octave information provided by the note detect and assignor 11.

Top octave synthesizers and associated octave dividers are well-known subsystems for musical tone generators. One such top octave synthesizer implementation with an associated octave divider is described in U.S. Pat. No. 4,386,456. This patent is hereby incorporated by reference.

The low pass filter 14 is implemented to attenuate all but the fundamental frequency of the square wave signal provided by the octave divider 13.

The constant multiplier 15 adjusts the peak amplitude of the input which is essentially a sinusoid waveshape so that the output is maintained at 1.1547 times the peak value of the square wave signal from the octave divider 13. Means for implementing the constant amplifier 15 are known in the analog signal art. For example, an AGC (automatic gain control) amplifier can be used in which the gain control signal is obtained from the square wave output signal from the octave divider 13.

The essentially sinusoid signal output from the constant amplifier 15 is subtracted from the square wave output from the octave divider 13 by means of the subtract 16.

The zero crossing detect 17 detects the zero crossings of the signal provided by the subtract 4. A pulse-like signal is generated each time that a zero crossing is detected. The zero crossing detect 17 can be implemented as a signal comparator which provides a signal output when the input signal attains a zero amplitude value. These pulse-like signals form a sequence of threshold signals.

The square wave generator 18 generates as square wave whose edges correspond to the pulse-like signals created by the zero crossing detect 17. The resulting square wave will correspond to a fundamental frequency which is three times greater than the fundamental frequency of the square-wave generated by the octave divider 13.

The square wave produced by the square wave generator 18 is filtered to modify its spectral content by means of filters contained in the system block labeled formant filters 19. The resulting waveshape is converted into audible sound by means of a conventional amplifier and speaker system contained in the system block labeled 20. The resultant musical tone will be at a frequency three times higher than the frequency associated with the actuated keyboard switch. This is equivalent to generating a musical tone at a $2\frac{2}{3}$-foot pitch.

It is known that a square-wave signal has a frequency spectrum containing only the odd-numbered harmonics. If the wave shape is truly symmetrical and has flat tops, then there will be no even-harmonic contributions in the frequency spectrum. The power spectral spectrum for an ideal shaped square wave has spectral components expressed in db given by the relation $$db(n)=20\log_{10}(1n);\ n=1,3,5,7,\ldots \qquad \text{Eq. 1}$$

Figure 2:
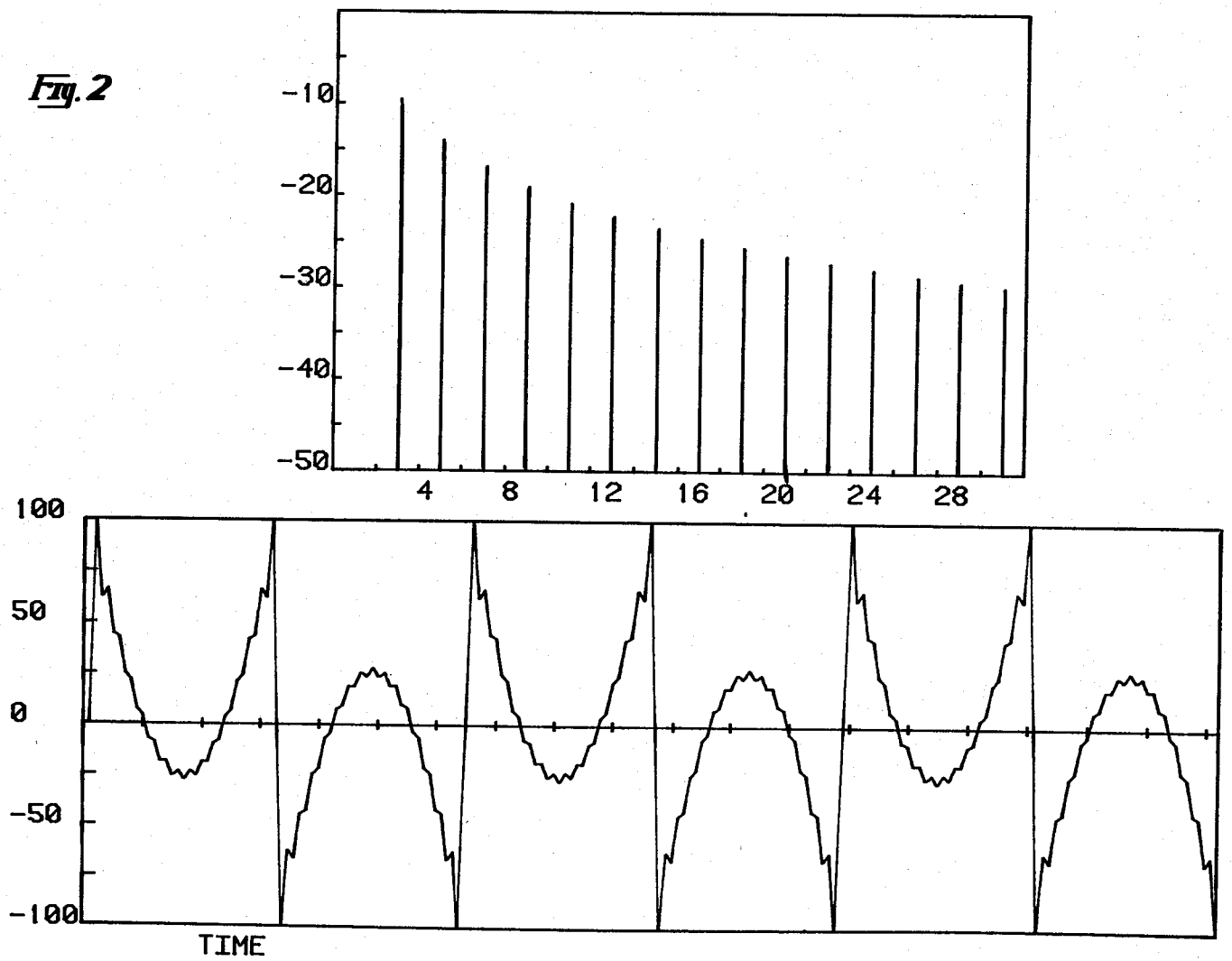
FIG. 2 is a spectral plot of a square wave without the fundamental frequency.

FIG. 2 illustrates the spectrum and waveshape for three periods of a square wave in which the fundamental frequency component has been eliminated. The waveshape is constructed for illustration corresponding to a sequence of 64 sample points per period. This choice is merely illustrative and is not a limitation or restriction of the inventive concept. The waveshape in FIG. 2 corresponds to the waveshape appearing at the output of the subtract 16. It is noted that the zero crossings for the waveshape divide the period into six equal time segments.

The peak value of a sinusoid of the same fundamental frequency of the square wave such that its subtraction from the square wave will produce the waveshape shown in FIG. 2 is $$Amp=1/\sin(\pi/3) \qquad \text{Eq. 2}$$

The curves shown in FIG. 2 correspond to the case in which the fundamental frequency of the square wave is in phase with the sinusoid which is used to eliminate the fundamental frequency of the square wave. Computer simulations to determine the effect of a phase shift between these two frequency components indicated that satisfactory generation of the mutation pitch results if the phase shift is less than about 34 degrees. This wide latitude, or phase shift insensitivity, is easily attainable with the system implementation shown in FIG. 1.

Figure 3:
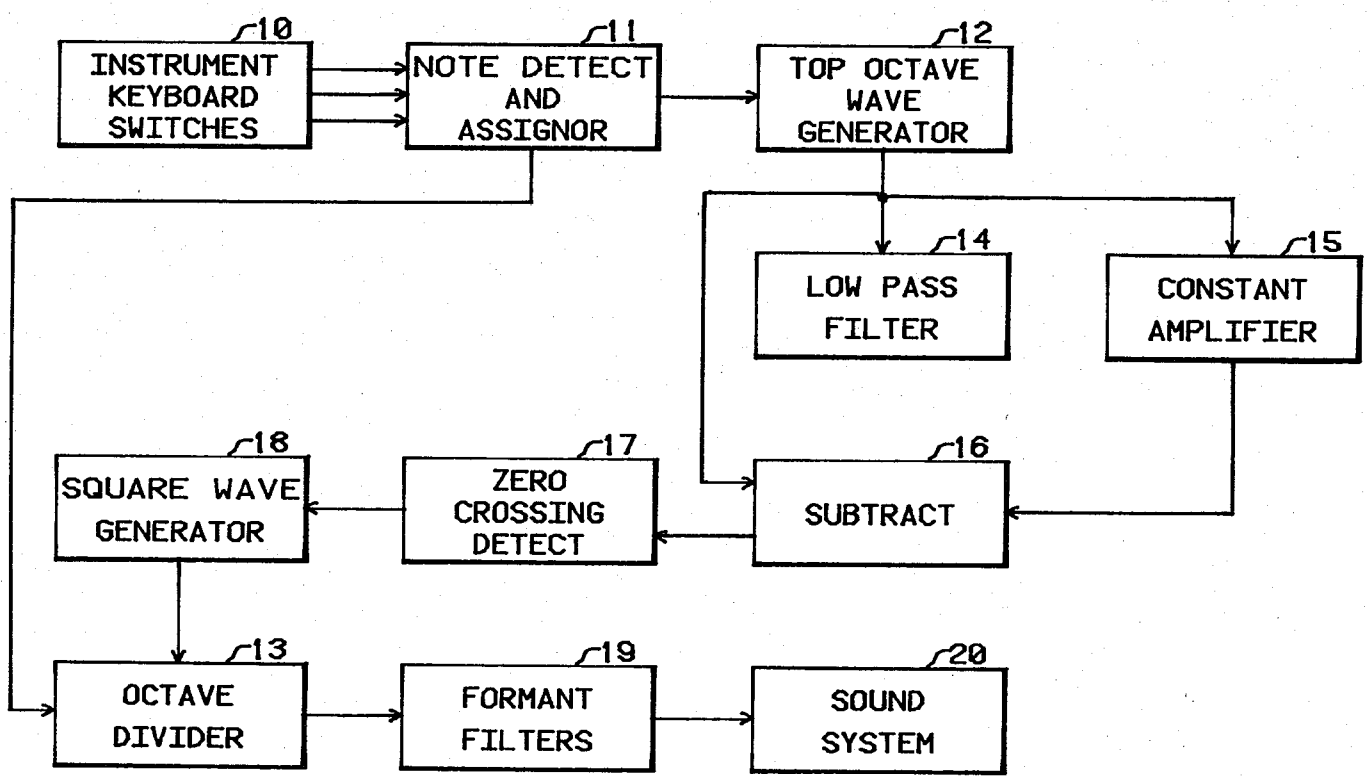
FIG. 3 is an alternate embodiment of the invention.

An alternative system arrangement is shown in FIG. 3. In this arrangement the harmonic suppression action takes place directly on the square wave produced by the top octave wave generator 12. The square wave created at the mutation pitch by the square wave generator 8 is divided down to the proper octave frequency by means of the octave divider 13. This alternative arrangement is more tolerant of phase differences between the signal produced by the low pass filter and the square wave produced by the top octave wave generator 12 than the system shown in FIG. 1. The phase shift errors are translated to the production of nonsymemtrical rectangular waveshapes. The non-symmetry gives rise to an undesired frequency component at the unison, or fundamental pitch, of the original square wave before the harmonic suppression action. Each time the resultant square wave at the mutation pitch is divided by an octave, the amount of non-symmetry is reduced. Thus the placement of the octave divider 13 as shown in FIG. 3 produces a resultant mutation pitch tone which is fairly insensitive to the above mentioned phase shift errors.

Figure 4:
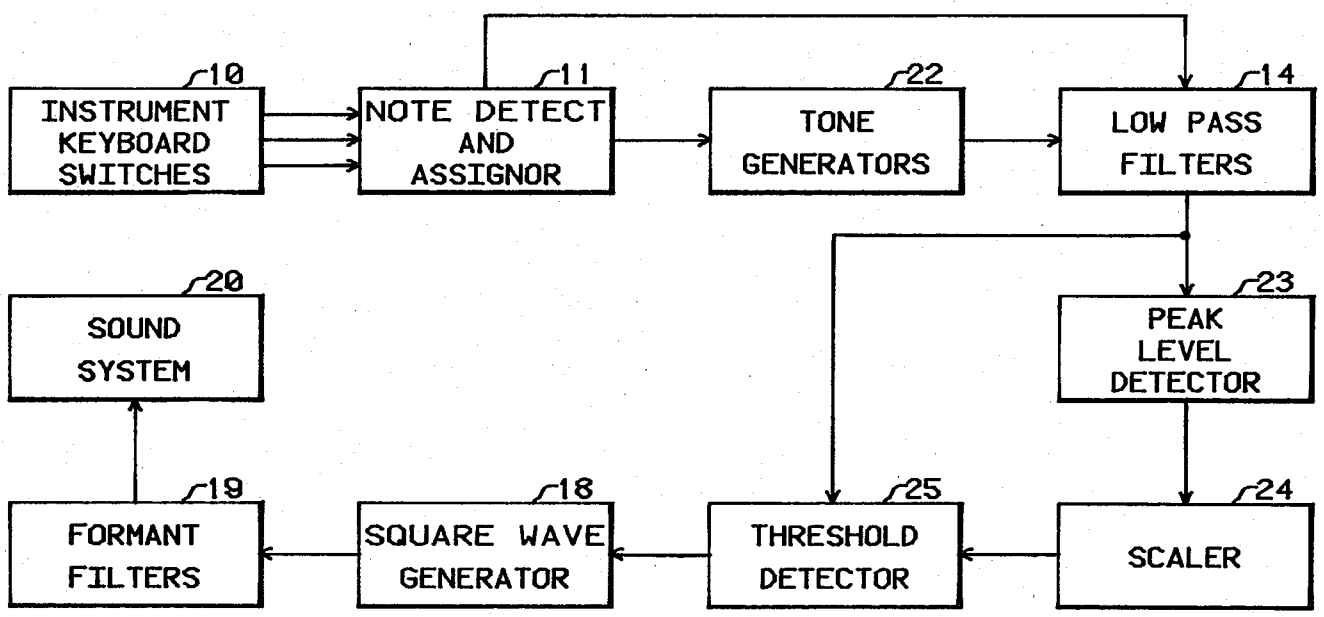
FIG. 4 is another alternate embodiment of the invention.

FIG. 4 illustrates another embodiment of the invention. In response to an actuated keyswitch in the instrument keyboard switches 10, the note detect and assignor 11 assigns a tone generator contained in the tone generators 22. The assigned tone generator creates a musical waveform having a fundamental frequency corresponding to its assigned actuated keyswitch.

The low pass filter 14 attenuates all but the fundamental frequency of the waveshape produced by the tone generator.

The peak level detector 23 determines the positive peak amplitude of its input signal and generates a constant positive signal having the same peak amplitude. The scaler 23 scales the signal generated by the peak level detector 23 to a value which is 0.866 times the positive peak amplitude of the signal output from the low pass filter 14. The scaler 23 can be implemented in the form of a conventional resistor network voltage divider.

The threshold detector 25 compares the absolute magnitude of the signal output from the low pass filter 14 with the threshold signal provided by the scaler 24. Each time that these signals are equal in absolute magnitude, a detect signals is generated by the threshold detector 25.

The square wave generator 18 generates a rectangular waveshape signal whose edges, or transition changes, correspond to the detect signals produced by the threshold detector. The resultant rectangular waveshape signal will have a fundamental frequency which is three times the fundamental frequency produced by the source tone generator. The resultant square wave is altered in harmonic content by means of the formant filters 19 to produce a tone at the mutation 2⅔-foot pitch corresponding to the actuated keyswitch.

The tone generating system shown in FIG. 4 is equivalent to the tone generation systems shown in FIG. 1 and FIG. 3. In the system shown in FIG. 4, the peak level detector furnishes a threshold signal which is equivalent in function to the signal level established by the square wave input signals of the other systems. The threshold detector 25 is essentially a device that subtracts a sinusoid of a prespecified amplitude from the height of a square wave. Thus this system acts effectively as a harmonic suppression system such as in the two systems previously described.

The same method of harmonic suppression can be extended to create other mutation stops from an input square-wave. For example, a 1 3/5-foot pitch can be created by suppressing, or subtracting out, the fundamental and third harmonic from a square wave signal. The net result is that the fifth harmonic of the original waveshape signal becomes the dominant harmonic. The harmonic suppressed signal can be used in a manenr analogous to that described above to form a musical waveshape at the 1 3/5-foot mutation pitch.

While the invention has been explicitly illustrated for an analog signal system, this is not a restriction or limitation of the invention. It is evident that the illustrative system embodiments are equally applicable to a digital signal system in which the signal amplitudes are represented by a time sequence of binary numbers.

I claim:

1. In combination with an electronic musical instrument having a keyboard array of keyswitches, apparatus for producing musical tones at mutation pitches comprising;

a keyswitch state detect means wherein a detect signal is generated in response to each actuated keyswitch in said keyboard array of keyswitches, a plurality of square wave generates each of which generates a square wave signal at a frequency determined by an associated assignment signal, an assignment means responsive to each said detect signal whereby said associated assignment signal is generated, a plurality of harmonic suppression means each of which is associated with a corresponding one of said plurality of square wave generators whereby selected harmonics of said generated square wave signal are attenuated, to produce a suppressed wave signal, a plurality of waveshape means each of which is associated with a corresponding one of said plurality of harmonic suppression means and responsive to a corresponding one of said suppressed wave signals wherein a rectangular waveshape signal is generated at a frequency which is a multiple of the frequency of said square signal generated by the corresponding one of said plurality of square wave generators, and a tone production means responsive to said rectangular waveshape signal whereby said musical tone at a mutation pitch is produced.

2. In a musical instrument according to claim 1 wherein said keyswitch state detect means comprises;

an encoding means for encoding each said detect signal to generate a detect data word which identifies by octave number and musical scale note number each said actuated keyswitch corresponding to a generated detect signal.

3. In a musical instrument according to claim 2 wherein said assignment means comprises;

a decoding means for decoding each said detect data word to create said assignment signal which designates said octave number and the top octave frequency corresponding to an associated said actuated keyswitch.

4. In a musical instrument according to claim 3 wherein each one of said plurality of square wave generators comprises;

an octave divider means for dividing the frequency of said generated square wave signal in response to the octave number designated by said assignment signal.

5. In a musical instrument according to claim 1 wherein each of said plurality of harmonic suppression means comprises;

a filter means for creating a filtered signal by attenuating the harmonic overtones of the square wave signal produced by a corresponding one of said plurality of square wave generators, and a subtract means wherein said filtered signal is subtracted from its corresponding square wave signal to generate said suppressed wave signal.

6. In a musical instrument according to claim 1 wherein each said plurality of waveshape means comprises;

a threshold signal detect means responsive to an associated suppressed wave signal wherein one threshold signal in a sequence of threshold signals is generated when the amplitude of said associated suppressed wave signal is equal to a prespecified threshold amplitude value, and a rectangular wave generator wherein said rectangular waveshape signal is generated having amplitude level transitions each of which corresponds to one of said sequence of threshold signals.

7. In combination with an electronic musical instrument having a keyboard array of keyswitches, apparatus for producing musical tones at mutation pitches comprising;

a keyswitch state detect means wherein a detect signal is generated in response to each actuated keyswitch in said keyboard array of keyswitches, a plurality of tone generators each of which generates a musical waveshape at a frequency determined by an associated assignment signal, an assignment means responsive to each said detect signal whereby said associated assignment signal is generated, a plurality of harmonic suppression means each of which is associated with a corresponding one of said plurality of tone generators whereby selected harmonics of said generated musical waveshape are attenuated to produce a suppressed wave signal, a plurality of waveshape means each of which is associated with a corresponding one of said plurality of harmonic suppression means and responsive to a corresponding one of said suppressed wave signal wherein a rectangular waveshape signal is generated at a frequency which is a multiple of the frequency of said musical waveshape generated by the corresponding one of said plurality of tone generators, and a tone production means responsive to said rectangular waveshape signal whereby said musical tone at a mutation pitch is produced.

8. In a musical instrument according to claim 7 wherein said keyswitch state detect means comprises;

an encoding means for encoding each said detect signal to generate a detect data word which indentifies by musical frequency each said actuated keyswitch corresponding to a generated detect signal.

9. In a musical instrument according to claim 8 wherein said assignment means comprises;

a decoding means for decoding each said detect data word to create said assignment signal which designates the musical frequency corresponding to an associated said actuated keyswitch.

10. In a musical instrument according to claim 7 wherein each of said plurality of harmonic suppression means comprises;

a filter means for creating a filtered signal by attenuating all but the fundamental harmonics of the musical wave shape produced by a corresponding one of said plurality of tone generators, a signal level generating means wherein a threshold signal is generated corresponding to the maximum of the absolute value of said filtered signal, a threshold signal detect means responsive to said threshold signal and responsive to said filtered signal wherein one threshold signal in a sequence of threshold timing signals is generated when the amplitude of said filtered signal is equal to said threshold signal, and a rectangular wave generator wherein said rectangular waveshape signal is generated having amplitude level transitions each of which corresponds to one of said sequence of threshold timing signals.

11. In a musical instrument according to claim 10 wherein said signal level generating means comprises;

a constant amplitude generating means whereby said threshold signal is generated at a value of 0.866 of the maximum absolute value of said filtered signal.

* * * * *